United States Patent [19]

Lee

[11] Patent Number: 4,815,391

[45] Date of Patent: Mar. 28, 1989

[54] WHEELED ADJUSTMENT COMPUTER DESK

[75] Inventor: Yu Lee, Taipei, Taiwan

[73] Assignee: Ton Li Enterprises Co., Ltd., Taipei, Taiwan

[21] Appl. No.: 230,315

[22] Filed: Aug. 9, 1988

[51] Int. Cl.[4] ..... A47F 5/12

[52] U.S. Cl. ..... 108/7; 108/10; 108/106

[58] Field of Search ..... 108/1, 9, 10, 7, 106, 108/147

[56] References Cited

U.S. PATENT DOCUMENTS 3,988,021 10/1976 Grover ..... 108/10
4,440,096 4/1984 Rice et al. ..... 108/7
4,567,835 2/1986 Reese et al. ..... 108/7
4,604,955 8/1986 Fleischer et al. ..... 108/106
4,714,224 12/1987 Calmcs ..... 108/10

*Primary Examiner*—Francis K. Zugel
*Attorney, Agent, or Firm*—Connolly and Hutz

[57] ABSTRACT

A computer desk comprising a pair of U-shaped frames of which one is longer than and pivoted to the other, two pairs of wheels disposed on the ends of the limbs of each U-shaped frame, two boards engagably disposed on the top of the inverted U-shaped frames and height adjusting device. The height adjusting device comprises three length adjustable rods connecting between the frames and between the boards and the frames. Adjusting the length of the adjusting rods changes the height of the boards and the angles of the boards with respect to the plane of the horizon so that the height of the desk is adjusted.

1 Claim, 4 Drawing Sheets

WHEELED ADJUSTMENT COMPUTER DESK

BACKGROUND OF THE INVENTION

The present invention relates to improvements in computer desks and more particularly to a wheeled adjustable computer desk.

Computers are becoming popular throughout the world. Especially in the industrialized countries, computers are almost indispensable. With the advent of the computer age, people spend more and more time to work with the computers. In order to have a comfortable working environment, a good computer desk which provides suitable spacial relationship between the computer and the user is indispensable to the professional computer users. There are many different computer desks available on the market. These computer desks, however, are neither knockdown nor height adjustable. Since the sizes of different computers are different, the dimension of the computer desk should vary with the computer size so as to give the users the best spacial relationship with the computers. The non-height-adjustable computer desks will not suit every user's requirements. Furthermore, a computer desk which is knockdown will be convenient for the user to move the desk from one place to another. It is therefore the object of the present invention to provide a wheeled computer desk which is knockdown and height-adjustable.

SUMMARY OF THE INVENTION

It is the primary object of the present invention to provide a computer desk which is foldable and knockdown and thus is easy to move from one place to another.

It is another object of the present invention to provide a computer desk which is height-adjustable to accomodate many sizes of computers.

It is still another object of the present invention to provide a computer desk which is wheeled to provide further movability.

Other objects of the present invention will become apparent as the following specification progresses, reference being made to the accompanying drawings, wherein:

DETAILED DESCRIPTION OF THE PREFERRED EMBODIMENT

Figure 1:
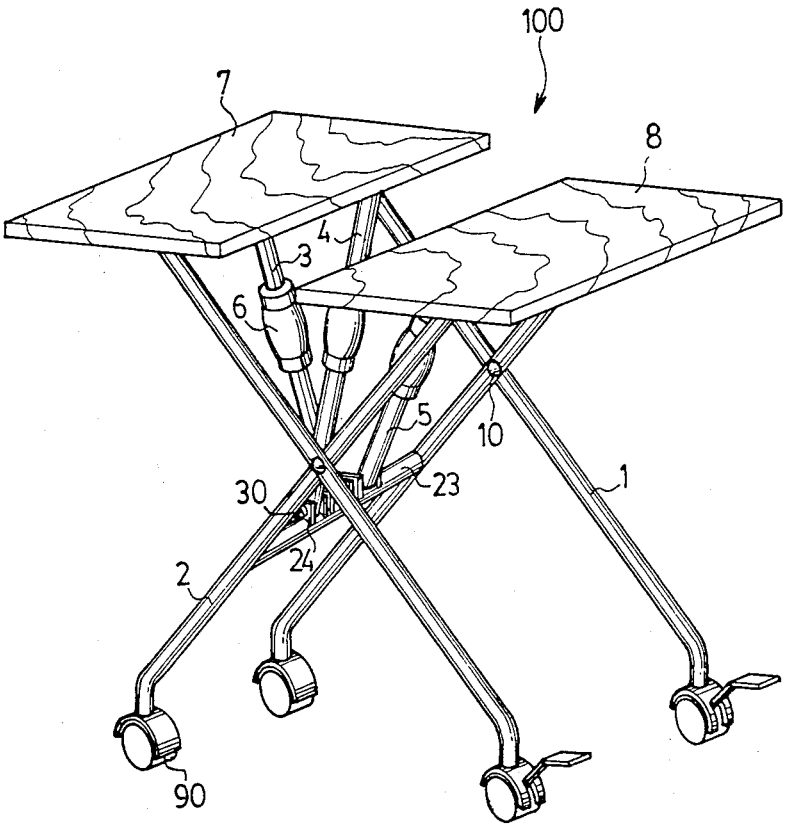
FIG. 1 is a perspective view of the wheeled adjustable computer desk in accordance with the present invention.
Figure 2:
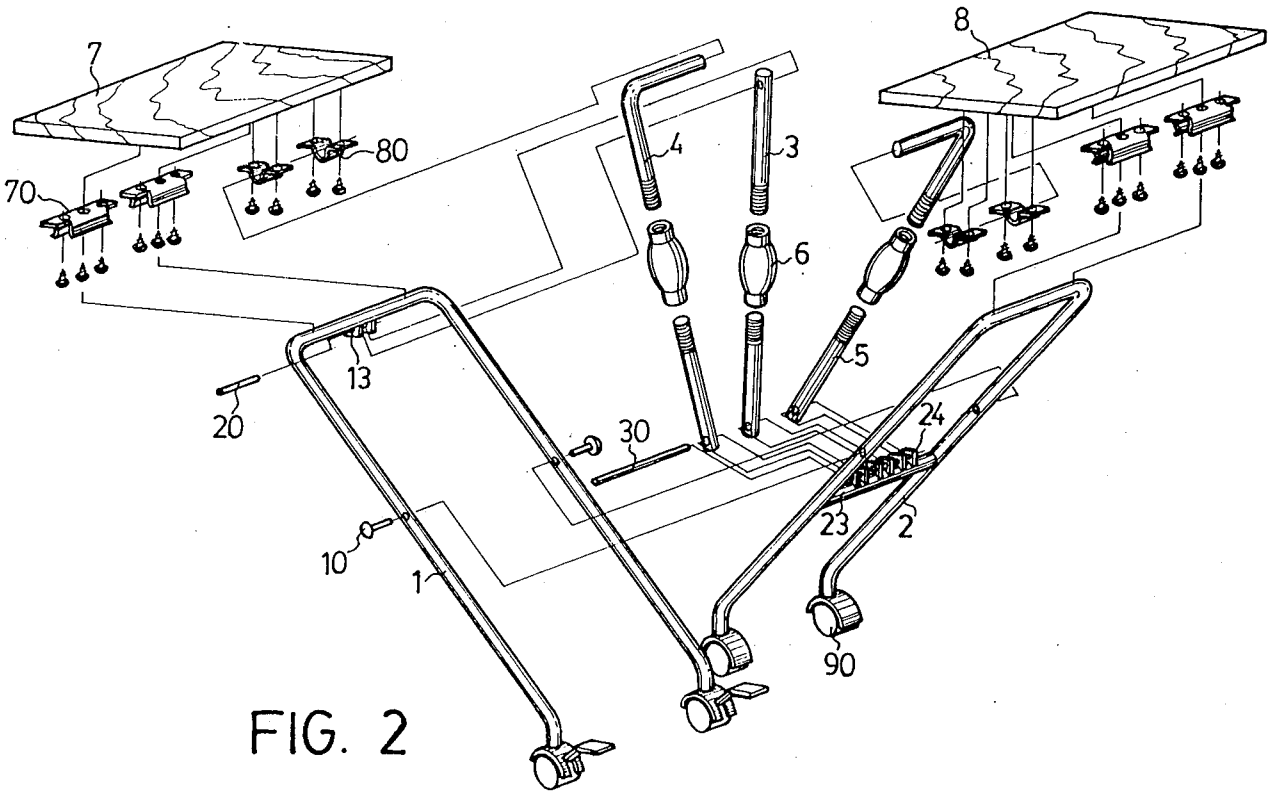
FIG. 2 is a fragmentary view of the wheeled adjustable computer desk shown in FIG. 1.

With reference to FIGS. 1 and 2, the wheeled adjustable computer desk 100 constitutes two boards 7, 8, a pair of inverted U-shaped frames 1, 2, three adjusting rods 3, 4, 5 and a support bar 23. One of the U-shaped frames (which is indicated by reference numeral 1) is longer than the other which is indicated by reference numeral 2. This is shown more clearly in FIGS. 4 and 5.

A wheel 90 is mounted on each end of both of the inverted U-shaped frames 1 and 2. The U-shaped frames are pivoted to each other at a suitable position with a pair of pins 10 so that the distance between the wheels 90 and the pin 10 is the same for both frames 1 and 2.

On the top of the longer frame 1, a first board 7 is mounted with mounting means 70, which is attached to the board 7 thereunder, and on the top of the shorter frame 2, a second board 8 is mounted with a similar mounting means. The mounting means 70 is a plurality of, preferably two, cylindrical clips which are made of elastic material so that the bottom of the U-shaped frame 1 or 2 can be pushed thereinto and retained therein.

Figure 3:
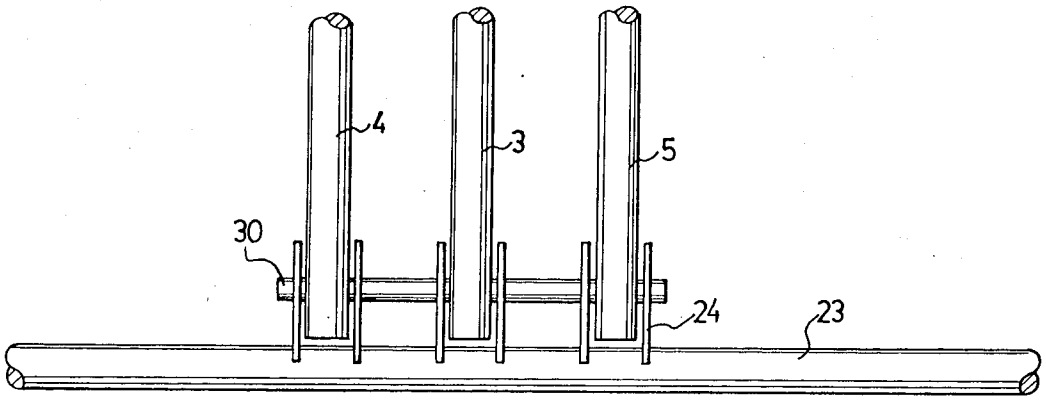
FIG. 3 is a view drawn to a larger scale to show the engagement of the adjusting rods with the desk frame.

At a suitable position between the wheels 90 and the pin 10 of the shorter frame 2, a support bar 23 is disposed between the limbs of the frame 2 and mounted thereon. Disposed on the support bar 23 are the seats 24 for the adjusting rods 3, 4 and 5. As more clearly shown in FIG. 3, each seat 24 is preferably constituted by a pair of plates with a hole therethrough. The adjusting rods 3, 4 and 5 with a hole therethrough can be pivoted in the seat with a long pin 30 going through all the holes.

The adjusting rods include a height-adjusting rod 3 and two board adjusting rods 4 and 5. The height-adjusting rod 3 with one end pivoted in the seat 24 is pivoted to the bottom of the longer frame 1 with the same means comprising a pair of apertured plates 13 and a pin 20. The board adjusting rods 4 and 5 with one end pivoted in the seat 24 is bent at the other end to form an L-shape. The bent portion of the board adjusting rods 4 and 5 is inserted through securing means 80 which is fixed under the board 7 and 8 and forms a channel therebetween to attach the board adjusting rods 4 and 5 to the boards 7 and 8, respectively. Each adjusting rod 3, 4 or 5 is constituted by two sections. An adjusting knob 6 having inner threads with different senses formed on the opposite ends thereof is screwable to the two sections with corresponding threaded portions thereon. With this structure, rotating the knob 6 lengthens or shortens the adjusting rod, depending upon the direction of rotation.

Figure 5:
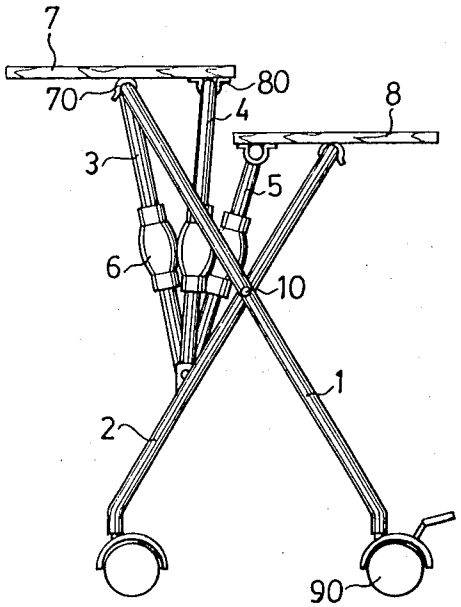
FIGS. 4 and 5 are two side elevational views which are placed together for comparison of different heights of the desk.
Figure 4:
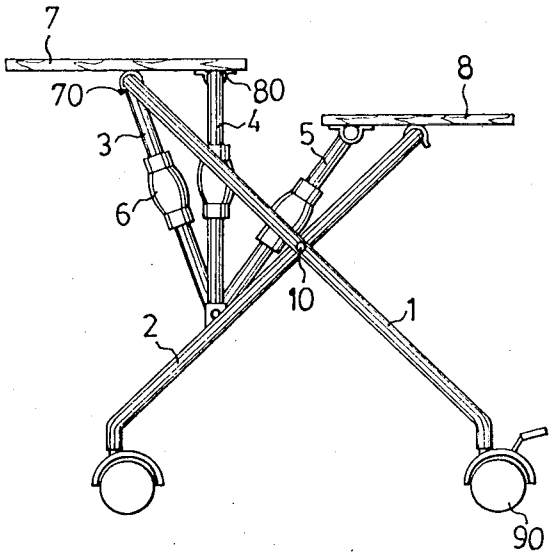

Referring to FIGS. 4 and 5, as the knob 6 is rotated in the direction for lengthening the height adjusting rod 3, the distance between the top of the longer frame 1 and the support bar 23 which is attached on the shorter frame 2, is increased. This moves the boards 7 and 8 upwards and toward each other and, thus, heightens the desk 100. After the height adjusting rod 3 is lengthened or shortened. It is necessary to adjust the board adjusting rods 4 and 5 with the knobs of the board adjusting rods to keep the boards 7 and 8 horizontal.

Although this invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A computer desk comprising a pair of inverted U-shaped frames of which one is longer than and pivoted to the other, two pairs of wheels disposed on the ends of the limbs of each said U-shaped frames, a support bar disposed between the limbs of said shorter frame and in parallel with the top of said shorter frame, three pivoting seats disposed on said support bar, three adjusting rods, including a height adjusting rod, which is holed in both ends, and two board adjusting rods, each of which is holed in one end and bent to a right angle on the other end, disposed pivotedly with a long pin in said pivoting seats respectively and two boards with a plurality of elastic engaging means mounted thereunder engagably disposed on the tops of said U-shaped frames respectively, each pivoting seat composed of a pair of holed plates mounted on said support bar and said pivoting seat being disposed in series with and closely to each other so that a long pin which goes through the holes formed on said pivoting seats and the holes on one end of each of said adjusting rods serves as the pivot for the adjusting rods, said height adjusting rod also pivoted to a pivoting seat which is disposed on the top of said longer U-shaped frame and is constituted by two holed plates and a short pin going through the holes thereof, said board adjusting rods further secured to said boards respectively with the bent portion thereof being slidably inserted into a plurality of tube securing means, each of said adjusting rods composed of two sections which are threaded with different sense in the opposed ends and are threadedly connected by a knob which is internally-threaded on two opposite ends with different senses so that when the knob of said height adjusting rod is rotated, the length of the height adjusting rod is lengthened or shortened and thus heightening or lowering said boards and when the knobs of said board adjusting rods are rotated, the angle between the boards and the plane of the horizon is adjusted.

* * * * *